US005909836A

United States Patent [19]

Shkolnikov et al.

[11] Patent Number: 5,909,836

[45] Date of Patent: Jun. 8, 1999

[54] COMBUSTION POWERED TOOL WITH COMBUSTION CHAMBER LOCKOUT

[75] Inventors: Yury Shkolnikov, Glenview; Tony Deieso, Wadsworth, both of Ill.

[73] Assignee: Illinois Tool Works Inc., Glenview, Ill.

[21] Appl. No.: 08/961,811

[22] Filed: Oct. 31, 1997

[51] Int. Cl.[6] ..... B25C 1/04

[52] U.S. Cl. ..... 227/8; 227/10; 227/130

[58] Field of Search ..... 227/8, 9, 10, 130; 123/46 SC

[56] References Cited

U.S. PATENT DOCUMENTS

| | | | |
|---|---|---|---|
| Re. 32,452 | 7/1987 | Nikolich | 123/46 |
| 3,042,008 | 7/1962 | Liesse | 227/10 |
| 3,964,659 | 6/1976 | Eiben | 227/8 |
| 3,967,771 | 7/1976 | Smith | 227/9 |
| 4,403,722 | 9/1983 | Nikolich | 227/8 |
| 4,480,528 | 11/1984 | Shiroyama | 227/130 |
| 4,483,473 | 11/1984 | Wagdy | 227/8 |
| 4,483,474 | 11/1984 | Nikolich | 227/8 |
| 4,522,162 | 6/1985 | Nikolich | 123/46.5 |
| 4,629,106 | 12/1986 | Howard | 227/8 |
| 4,717,060 | 1/1988 | Cotta | 227/10 |
| 4,739,915 | 4/1988 | Cotta | 227/10 |
| 5,197,646 | 3/1993 | Nikolich | 227/8 |
| 5,213,247 | 5/1993 | Gschwend | 227/10 |
| 5,263,439 | 11/1993 | Doherty et al. | 123/46 |
| 5,485,946 | 1/1996 | Jankel | 227/8 |
| 5,671,880 | 9/1997 | Ronconi | 227/130 |
| 5,680,980 | 10/1997 | Robinson | 227/10 |
| 5,687,897 | 11/1997 | Fa | 227/8 |

*Primary Examiner*—Scott A. Smith
*Assistant Examiner*—James P Calve
*Attorney, Agent, or Firm*—Greer, Burns & Crain, Ltd.

[57] ABSTRACT

A combustion powered tool having a self-contained internal combustion power source constructed and arranged for creating a combustion for driving a driver blade to impact a fastener and drive it into a work piece includes a housing constructed and arranged to enclose the power source, a combustion chamber defined at an upper end of the housing, a cylinder disposed in the housing to be in fluid communication with the combustion chamber, a piston associated with the driver blade and configured for reciprocal movement within the cylinder between a start position located at a first end of cylinder and a driving position located at a second end of the cylinder, a gas control device for periodically opening the combustion chamber to atmosphere, and a delay apparatus connected to the gas control device for delaying the opening of the combustion chamber until the piston returns to the start position after driving the fastener.

12 Claims, 3 Drawing Sheets

COMBUSTION POWERED TOOL WITH COMBUSTION CHAMBER LOCKOUT

BACKGROUND OF THE INVENTION

The present invention relates generally to improvements in portable combustion powered fastener driving tools, and specifically to improvements relating to the retarding of the post-combustion opening of the combustion chamber to allow the piston to properly return to the start position.

Portable combustion powered, or so-called IMPULSES® brand tools for use in driving fasteners into work pieces are described in commonly assigned patents to Nikolich U.S. Pat. Re. No. 32,452, and U.S. Pat. Nos. 4,522,162; 4,483,473; 4,483,474; 4,403,722 and 5,263,439, all of which are incorporated by reference herein. Similar combustion powered nail and staple driving tools are available commercially from ITW-Paslode of Lincolnshire, Ill. under the IMPULSE® brand.

Such tools incorporate a generally pistol-shaped tool housing enclosing a small internal combustion engine. The engine is powered by a canister of pressurized fuel gas, also called a fuel cell. A powerful, battery-powered electronic power distribution unit produces the spark for ignition, and a fan located in the combustion chamber provides for both an efficient combustion within the chamber, and facilitates scavenging, including the exhaust of combustion by-products. The engine includes a reciprocating piston with an elongate, rigid driver blade disposed within a cylinder body.

A valve sleeve is axially reciprocable about the cylinder and, through a linkage, moves to close the combustion chamber when a work contact element at the end of the linkage is pressed against a work piece. This pressing action also triggers a fuel metering valve to introduce a specified volume of fuel into the closed combustion chamber.

Upon the pulling of a trigger switch, which causes the ignition of a charge of gas in the combustion chamber of the engine, the piston and driver blade are shot downward to impact a positioned fastener and drive it into the work piece. The piston then returns to its original, or "ready" position through differential gas pressures within the cylinder. Fasteners are fed magazine-style into the nosepiece, where they are held in a properly positioned orientation for receiving the impact of the driver blade.

One of the design criteria for conventional combustion tools is that the trigger cannot be operated until the nosepiece is pressed against the work piece. This feature delays ignition until the combustion chamber is closed. A suitable trigger lockout mechanism is disclosed in U.S. Pat. No. 4,483,474, which is incorporated by reference. In the '474 patent, a cam and lever mechanism prevent depression of the trigger until the nosepiece is pressed against the work piece, closing the combustion chamber. Upon firing, the combustion chamber cannot open until the trigger is released.

A recent development in combustion tools is the creation of high energy tools which produce more force for driving the fasteners into the work piece. In some such tools, the additional force is obtained through the use of an extended cylinder through which the piston travels, thus providing the piston with a longer stroke. In other higher energy designs, the volume of the combustion chamber is increased. In these designs, the increased surface area of the combustion chamber is attempted to be minimized, and the surface area of the cylinder may remain the same. There is more combustion energy, but not equivalently more surface area for cooling and creating the differential pressure to return the piston to the start position. Accordingly, the piston returns more slowly.

In longer length tools, the time required for the return of the piston is increased as the length of the cylinder increases. It has been found that in some relatively recently-developed high energy combustion tools, the piston requires approximately twice as long to return to its start position as in conventional combustion tools having a relatively shorter stroke. Obviously, the tool should not be fired until the piston has been completely returned to the start position.

In combustion tools equipped as described above, in the event that the trigger switch is released and the tool lifted from the workpiece before the piston has returned to its start position, the valve linkage allows the combustion chamber to open, thus destroying the differential gas pressures which assist in the upward return of the piston. In order to have consistent firings, the size of the combustion chamber must always be the same.

Accordingly, it is an object of the present invention to provide an improved combustion powered tool which prolongs the sealed condition in the combustion chamber until the piston has returned to its pre-combustion start position.

Another object of the present invention is to provide an improved combustion powered tool which features a mechanism for keeping the combustion chamber closed until the piston returns to its start position.

A further object of the present invention is to provide an improved combustion powered tool wherein the combustion chamber is kept closed until the return of the piston by a mechanism which delays the release of the trigger switch, and, through connection to the lockout mechanism, thus ultimately delays the opening of the combustion chamber.

An additional object of the present invention is to provide an improved combustion powered tool featuring a trigger switch which is relatively easier to depress or activate than it is to return to its initial, non-activated position.

BRIEF SUMMARY OF THE INVENTION

The above-listed objects are met or exceeded by the present improved combustion powered fastener tool, which features a delay apparatus for delaying the opening of the combustion chamber post combustion until the piston has returned to its start position. In the preferred embodiment, the tool is provided with a trigger-operated combustion chamber lockout mechanism which prevents the unwanted opening of the combustion chamber until the trigger is released after firing. The delay apparatus retards the movement of the trigger from the ON position to the OFF position, thus providing additional time for the piston to return to the start position.

More specifically, the present invention provides a combustion powered tool having a self-contained internal combustion power source constructed and arranged for creating a combustion for driving a driver blade to impact a fastener and drive it into a work piece. Included in the present tool is a housing constructed and arranged to enclose the power source, a combustion chamber defined at an upper end of the housing, a cylinder disposed in the housing to be in fluid communication with the combustion chamber, a piston associated with the driver blade and configured for reciprocal movement within the cylinder between a start position located at a first end of cylinder and a driving position located at a second end of the cylinder, a gas control device for periodically opening the combustion chamber to atmosphere, and a delay apparatus connected to trigger switch assembly for delaying the opening of the combustion chamber until the piston returns to the start position after driving the fastener.

DETAILED DESCRIPTION OF THE INVENTION

Figure 1:
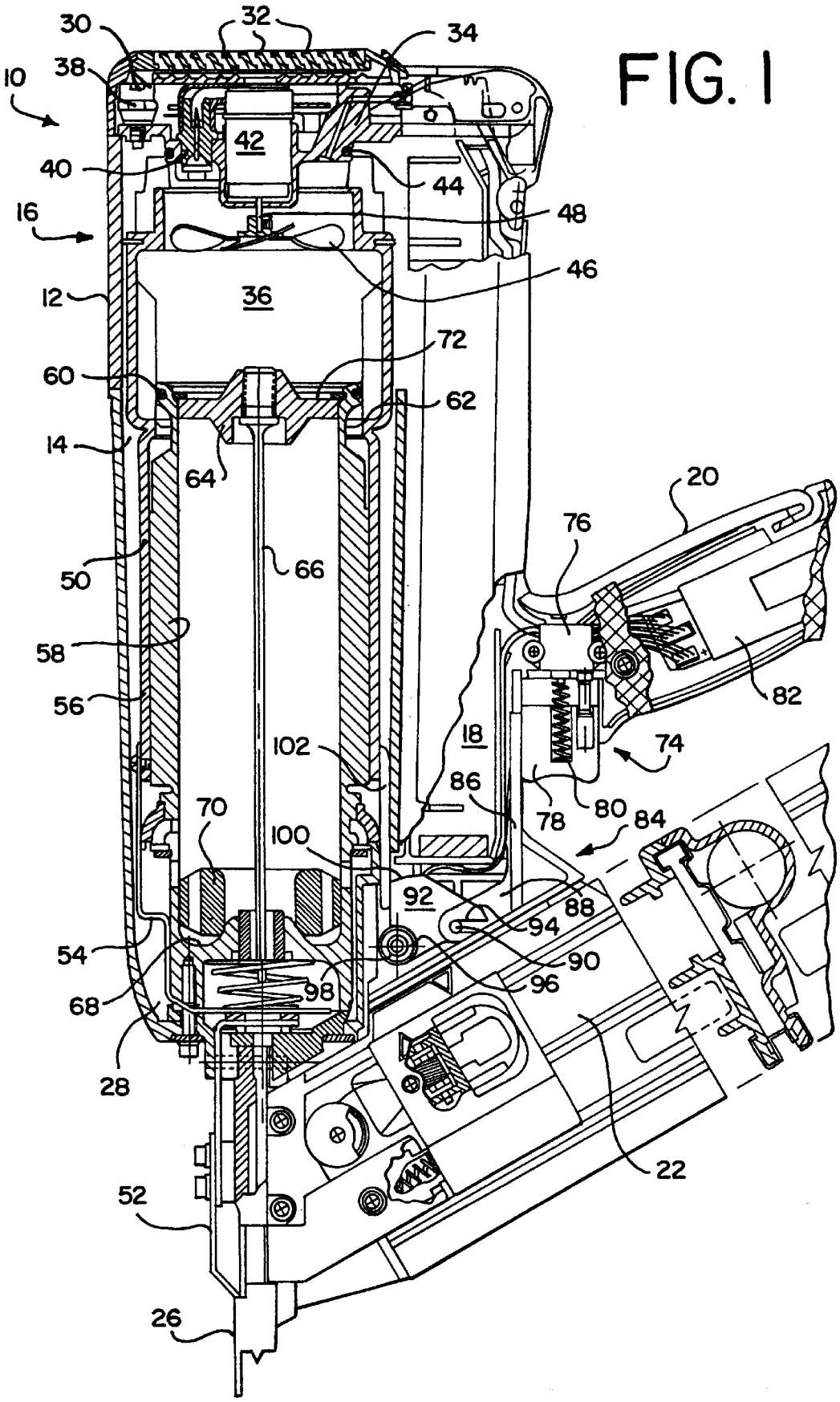
FIG. 1 is a fragmentary side view of a combustion powered fastener tool in accordance with the present invention shown with the combustion chamber open and the trigger in the OFF position, the tool being partially cut away for purposes of clarity.
Figure 2:
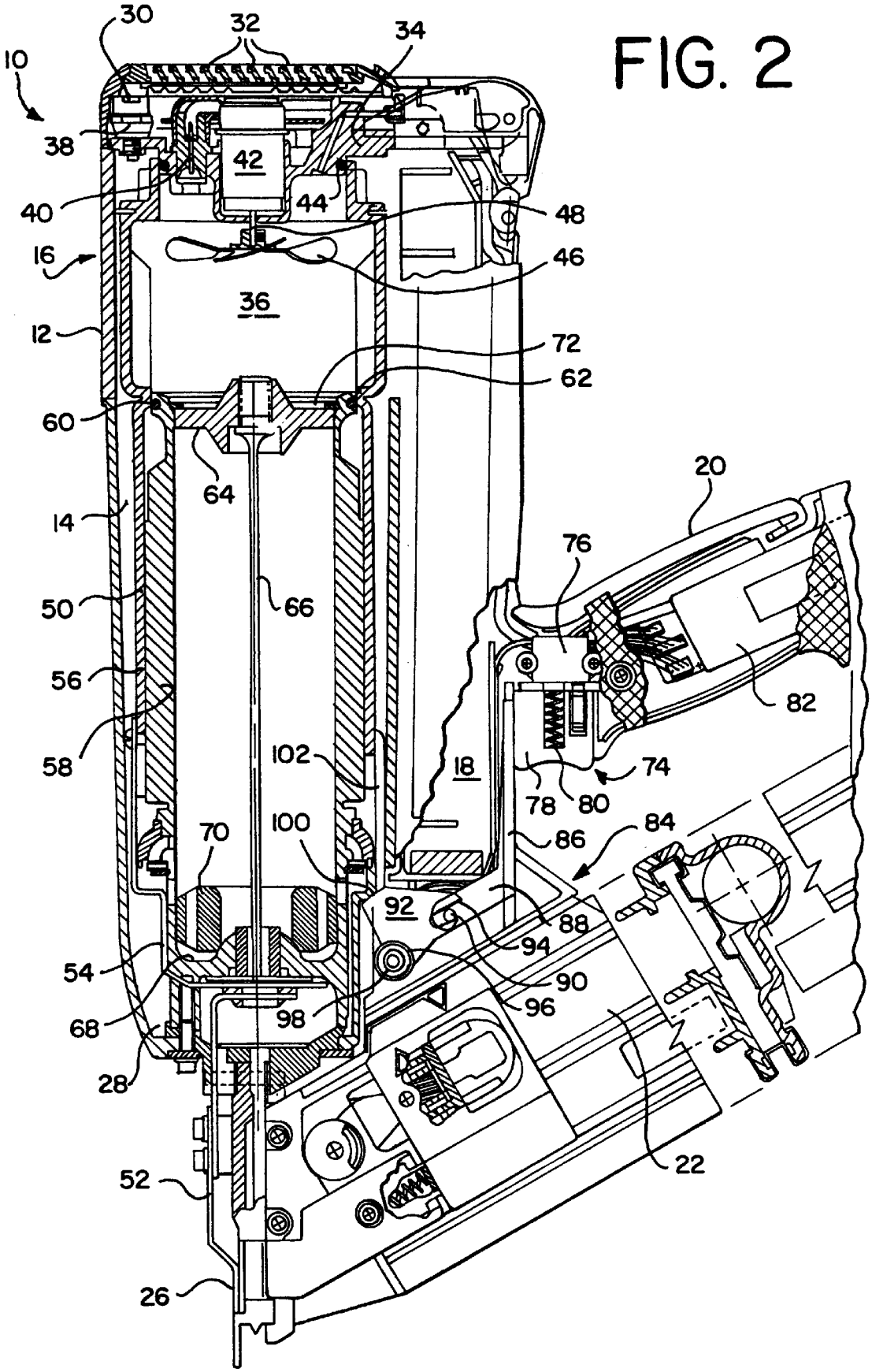
FIG. 2 is a fragmentary side view of the combustion powered fastener tool of FIG. 1 shown in with the combustion chamber closed and the trigger in the ON position, the tool being partially cut away for purposes of clarity.

Referring now to FIGS. 1 and 2, a combustion-powered tool of the type suitable for use with the present invention is generally designated 10. The tool 10 has a housing 12 including a main power source chamber 14 dimensioned to enclose a self-contained internal combustion power source 16, a fuel cell chamber 18 generally parallel with and adjacent the main chamber 14, and a handle portion 20 extending from one side of the fuel cell chamber and opposite the main chamber.

In addition, a fastener magazine 22 is positioned to extend generally parallel to the handle portion 20 from an engagement point with a nosepiece 26 depending from a first or lower end 28 of the main chamber 14. A battery (not shown) is provided for providing electrical power to the tool 10, and is releasably housed in a tubular compartment (not shown) located on the opposite side of the housing 12 from the fastener magazine 22.

As used herein, "lower" and "upper" are used to refer to the tool 10 in its operational orientation as depicted in FIGS. 1 and 2; however it will be understood that this invention may be used in a variety of orientations depending on the application. Opposite the lower end 28 of the main chamber is a second or upper end 30, which is provided with a plurality of air intake vents 32.

In a preferred embodiment, an electromagnetic, solenoid-type fuel metering valve (not shown) or an injector valve of the type described in commonly-assigned U.S. Pat. No. 5,263,439 is provided to introduce fuel into the combustion chamber as is known in the art. The above-identified U.S Pat. No. 5,263,439 is incorporated by reference. A pressurized liquid hydrocarbon fuel, such as MAPP, is contained within a fuel cell located in the fuel cell chamber 18 and pressurized by a propellant as is known in the art.

Returning to the main chamber 14, a cylinder head 34 is disposed at the upper end 30 of the main chamber, defines an upper end of a combustion chamber 36, and provides a mounting point for a head switch 38, a spark plug 40, an electric fan motor 42, and a sealing O-ring 44.

A combustion chamber fan 46 is attached to an armature 48 of the motor 42 and is located within the combustion chamber to enhance the combustion process and to facilitate cooling and scavenging. The fan motor 42 is controlled by the head switch 38, as disclosed in more detail in the prior patents incorporated by reference.

A generally cylindrical, reciprocating valve member 50 is moved within the main chamber 14 by a work piece-contacting element 52 on the nosepiece 26 using a linkage 54 in a known manner. The valve member 50 serves as a gas control device in the combustion chamber 36, and sidewalls of the combustion chamber are defined by the valve member, the upper end of which sealingly engages the O-ring 44 to seal the upper end of the combustion chamber (best seen in FIG. 2). A lower portion 56 of the valve member 50 circumscribes a generally cylindrical cylinder body or cylinder 58. An upper end of the cylinder body 58 is provided with an exterior O-ring 60 which engages a corresponding portion 62 of the valve member 50 (best seen in FIG. 2) to seal a lower end of the combustion chamber 36.

Within the cylinder body 58 is reciprocally disposed a piston 64 to which is attached a rigid, elongate driver blade 66 used to drive fasteners (not shown), suitably positioned in the nosepiece 26, into a work piece (not shown). A lower end of the cylinder body defines a seat 68 for a bumper 70 which defines the lower limit of travel of the piston 64. At the opposite end of the cylinder body 58, a piston stop retaining ring 72 is affixed to limit the upward travel of the piston 64.

Located in the handle portion 20 of the housing 12 are the controls for operating the tool 10. A trigger switch assembly 74 includes a trigger switch 76, a trigger 78 and a biased return member 80, which in the preferred embodiment is a coiled spring. An electrical control unit 82 under the control of the trigger switch 76 activates the spark plug 40.

The operation of the trigger 78 between an OFF position (FIG. 1) and an ON position (FIG. 2) is controlled by a cam interlock or trigger lockout mechanism, generally referred to as 84, which prevents actuation of the trigger until the tool 10 is pressed against a work piece. Such pressure causes the nosepiece 26 to be depressed, causing the linkage 54 to move the valve member 50 upward to close the combustion chamber 36 and seal it from the atmosphere.

More specifically, and referring now to FIGS. 1–4, the lockout mechanism 84 includes a trigger bracket 86 which is secured at one end to the trigger 78 and at the other, has an angled arm 88 which is provided with a transverse pivot pin 90.

Engaged on the pin 90 is a generally triangular-shaped releasing cam 92 provided with an open ended slot 94 dimensioned to slidingly engage the pin 90. Also provided to the cam 92 is a throughbore 96 which matingly engages a pivot bushing 98, and a cam lobe 100. Referring now to FIG. 1, the cam lobe 100 engages an end of a generally U-shaped rod 102 when the combustion chamber 36 is open to the atmosphere. This engagement prevents the depression of the trigger 78, and thus prevents ignition.

Referring now to FIG. 2, since the U-shaped rod 102 is attached to the valve member 50, as the combustion chamber 36 is closed by the valve member, the rod 102 moves upward with the valve member, which creates a clearance for the movement of the releasing cam 92 past the rod. With the cam 92 free to move, the trigger 78 can be depressed to cause ignition. This lockout mechanism 74 is described in greater detail in commonly-assigned U.S. Pat. No. 4,483,474.

As the trigger 78 is pulled, a signal is generated from the central electrical distribution and control unit 82 to cause a discharge at the spark gap of the spark plug 40, which ignites the fuel which has been injected into the combustion chamber 36 and vaporized or fragmented by the fan 46. This ignition forces the piston 64 and the driver blade 66 down the cylinder body 58, until the driver blade contacts a fastener and drives it into the substrate as is well known in the art. The piston then returns to its original, or "ready"

position through differential gas pressures within the cylinder, which are maintained in part by the sealed condition of the combustion chamber. If the combustion chamber 36 is opened before the piston returns to its start position, seen in FIGS. 1 and 2, then this differential gas pressure relationship is destroyed, which interferes with the return of the piston.

It has been found that with high energy combustion powered tools having a relatively longer cylinder body 58 or larger combustion chamber, additional time is required for the piston 64 to return to the start position, seen in FIGS. 1 and 2. In these models, the potential exists, upon release of the trigger 78, for the combustion chamber to be prematurely opened. It will be seen from FIGS. 1 and 2 that as long as the trigger 78 is depressed, the U-shaped rod 102 cannot move downward to release the valve member 50 from its position sealing the combustion chamber. However, once the trigger 78 is released, the cam 92 moves to the position of FIG. 1 and permits the rod 102 to move downward, opening the combustion chamber.

As stated above, it is important that the combustion chamber 36 not be opened before the piston has returned to the start position. Thus, an important feature of the present invention is the provision of a delay apparatus for retarding the opening of the combustion chamber. In a preferred embodiment, this is accomplished by retarding the release of the trigger 78 from its depressed or ON position, until the piston 64 fully returns.

Figure 3:
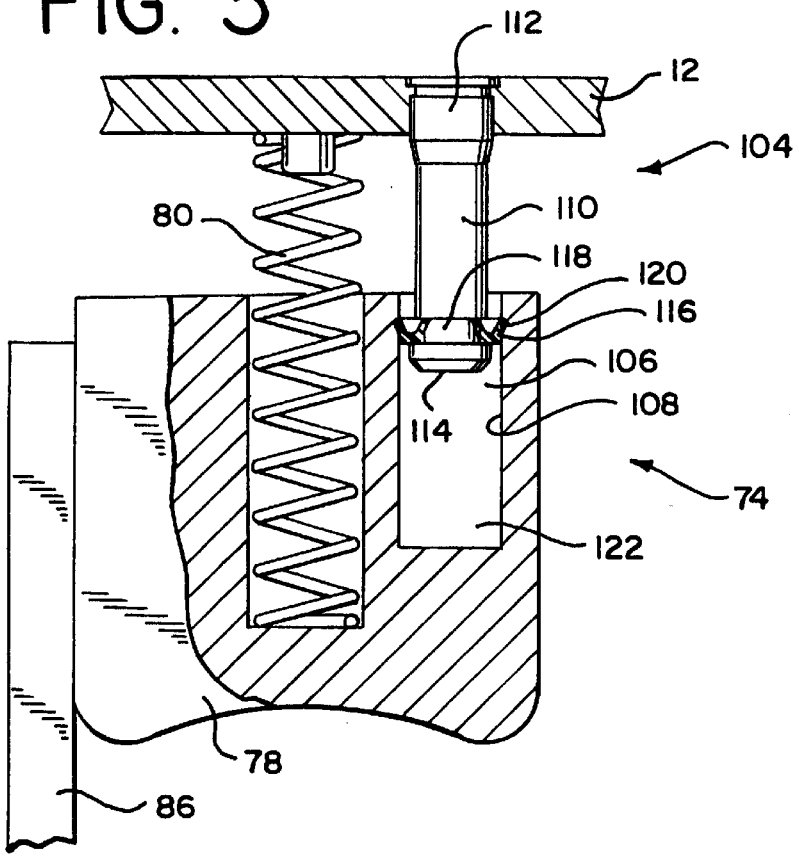
FIG. 3 is an enlarged, partially cut away view of the trigger assembly and the pneumatic delay valve of the present invention shown in the OFF position.
Figure 4:
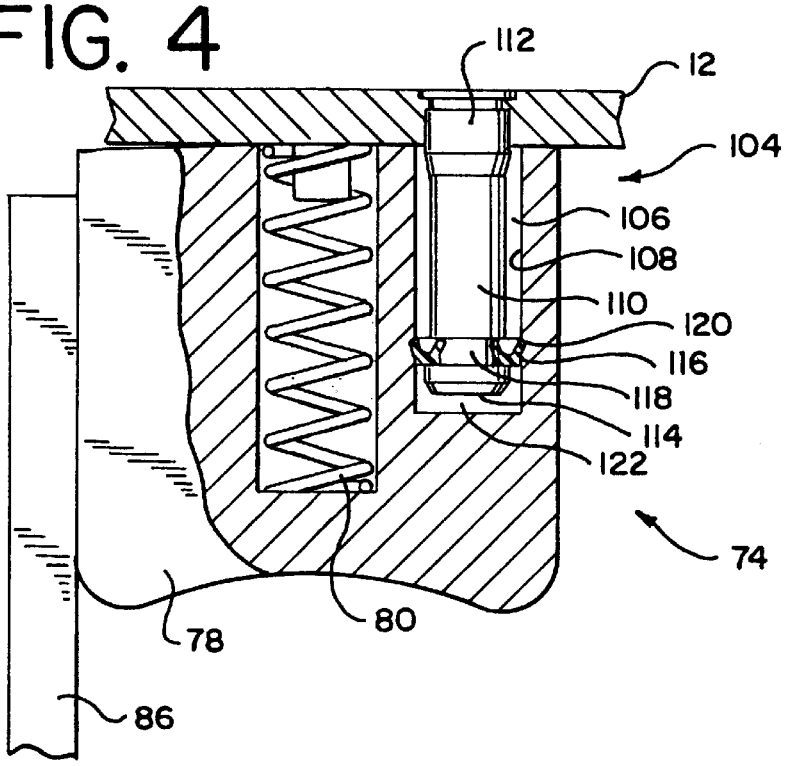
FIG. 4 is an enlarged partially cut away view of the trigger assembly and the pneumatic delay valve of FIG. 3 shown in the ON position.

Referring now to FIGS. 3 and 4, the delay apparatus of the invention is generally designated 104, and, in the preferred embodiment, features a pneumatic check valve configured for delaying the action of the biased return member or coil spring 80 which returns the trigger 78 to the released or OFF position shown in FIG. 3. The pneumatic check valve includes a cavity 106 defined by generally cylindrical inside wall 108 located within the trigger 78. A plunger 110 is fixed at a base end 112 to a support formation in the housing 12 by a friction fit, a threaded fastener or other known fastening technology. At the opposite end or tip 114, the plunger 110 matingly engages the cavity 106.

In the preferred embodiment, the plunger 110 is equipped with a sealing member 116 secured within an annular groove 118 located near the tip 114. A friction fit and/or chemical adhesives may be used to secure the sealing member 116 in place. The sealing member 116 is preferably a so-called "U-cup" seal, which has an outer lip 120 projecting at an oblique angle relative to the longitudinal axis of the plunger 110 to form a barb or arrowhead-type configuration. Thus, the lip 120 wipingly engages the inside wall 108 of the cavity 106, and creates friction which counters the action of the biased return member 80 and delays the return of the trigger 78 to the OFF position. In other words, the sealing member 116 is disposed on the plunger 110 so that the trigger is easy to pull to the ON position (FIG. 4), but is slower in its return to the OFF position (FIG. 3).

When the trigger 78 is depressed, the movement of the trigger over the plunger 110 forces a substantial amount of the residual air from the cavity 106, creating a relative vacuum in the region 122 of the cavity behind the sealing member 116. Due to inherent imperfections in the sealing member 116, which is preferably made of buna-N or butyl rubber or equivalent, this vacuum is not complete, and, as a result of the force applied by the biased return member 80, the air will slowly leak into the region 122, thus permitting the spring 80 to push the trigger 78 to return to the OFF position. Skilled practitioners will appreciate that the sealing member 116 must not be made so as to create a total seal, for that would create a vacuum which would prevent the return of the trigger 78 to the OFF position. In some applications, the lip 120 may be coated with grease to cause it to slide easier in the cavity 106.

In the preferred embodiment, the plunger 110 and the cavity 106 are so dimensioned that the vacuum created in the region 122 is sufficient to delay the trigger 78 reaching the OFF position until the piston 64 returns to the start position. It has been found that the incorporation of the present delay apparatus 104 into the tool 10 has generally doubled the time required to return the trigger 78 to its OFF position when compared with more conventional combustion powered tools. When equipped with the present delay apparatus, the time required for the trigger 78 to reach the OFF position from the ON position is approximately 200 milliseconds.

Thus, it will be seen that the present delay mechanism, in the form of the pneumatic valve, provides sufficient delay to the movement of the trigger 78 to the OFF position, and ultimately delays the opening of the combustion chamber 36 until the piston 64 reaches the start position. It will be appreciated that other mechanisms known to skilled practitioners may be utilized to maintain the combustion chamber closed until the piston reaches the start position, and still be within the scope of the present invention.

While a particular embodiment of the combustion chamber lockout for a combustion-powered tool of the invention has been shown and described, it will be appreciated by those skilled in the art that changes and modifications may be made thereto without departing from the invention in its broader aspects and as set forth in the following claims.

We claim:

1. A combustion powered tool having a self-contained internal combustion power source constructed and arranged for creating a combustion for driving a driver blade to impact a fastener and drive it into a work piece, comprising:

a housing constructed and arranged to enclose the power source;

a combustion chamber defined in said housing;

a cylinder disposed in said housing to be in fluid communication with said combustion chamber;

a piston associated with the driver blade and configured for reciprocal movement within said cylinder between a start position located at a first end of said cylinder and a driving position located at a second end of said cylinder;

gas control means for opening said combustion chamber to atmosphere when said tool is not in contact with a work surface;

a trigger switch assembly disposed in said housing and including a trigger;

a lockout mechanism connected to said trigger switch assembly for preventing combustion in said combustion chamber until said chamber is atmospherically sealed; and delay means connected to said trigger switch assembly for delaying the opening of said combustion chamber by said lockout mechanism after release of said trigger and until said piston returns to said start position after driving the fastener.

2. The tool as defined in claim 1, wherein said trigger switch assembly includes said trigger operating between an ON and an OFF position, said delay means being configured for delaying the movement of said trigger from said ON position to said OFF position until said piston returns to said start position.

3. The tool as defined in claim 2, wherein said trigger switch assembly includes said trigger, a trigger switch, a biased return member, and a pneumatic check valve configured for delaying the action of said biased return member.

4. The tool as defined in claim 3, wherein said pneumatic check valve includes a cavity with inside walls located in said trigger, a plunger fixed to said housing and matingly engaged in said cavity, said plunger having a sealing member for wipingly engaging said inside walls so that the engagement of said sealing member with said cavity creates friction which counters the action of said biased return member and delays the return of said trigger to said OFF position.

5. The tool as defined in claim 4, wherein said sealing member has a lip projecting at an angle relative to a longitudinal axis of said plunger.

6. The tool as defined in claim 1, wherein said gas control means is a reciprocating valve member which is moved within the housing by a work piece-contacting element, said valve member being constructed and arranged to releasably seal said combustion chamber from atmosphere, said trigger switch assembly having said trigger operating between an ON and an OFF position, and said delay means being configured for delaying the opening of said valve by said lockout mechanism by delaying the movement of said trigger to said OFF position.

7. The tool as defined in claim 6, wherein said trigger switch assembly is provided with said trigger, a trigger switch, a biased return member and a pneumatic check valve configured for delaying the action of said return spring.

8. The tool as defined in claim 7, wherein said pneumatic check valve includes a cavity with inside walls located in said trigger, a plunger fixed to said housing and matingly engaged in said cavity, said plunger having a sealing member for wipingly engaging said inside walls so that the engagement of said sealing member with said cavity creates friction which counters the action of said biased return member and delays the return of said trigger to said OFF position.

9. A combustion powered tool having a self-contained internal combustion power source constructed and arranged for creating a combustion for driving a driver blade to impact a fastener and drive it into a work piece, comprising:

a housing constructed and arranged to enclose the power source;

a combustion chamber defined in said housing;

a cylinder disposed in said housing to be in fluid communication with said combustion chamber;

a piston associated with the driver blade and configured for reciprocal movement within said cylinder between a start position located at a first end of said cylinder and a driving position located at a second end of said cylinder;

a trigger switch assembly disposed in said housing and connected to said power source for initiating combustion in said combustion chamber, said trigger switch assembly including a trigger operating between an ON position and an OFF position;

a lockout mechanism connected to said trigger switch assembly for controlling opening of said combustion chamber to atmosphere;

a valve assembly connected to said lockout mechanism for releasably sealing said combustion chamber from atmosphere; and delay means connected to said trigger switch assembly for delaying the opening of said combustion chamber by said valve assembly until said piston returns to said start position after driving the fastener, said delay means incorporating a pneumatic check valve, the operation of which creates a vacuum assisted friction force after release of said trigger for delaying the movement of said trigger from said ON position to said OFF position until said piston returns to said start position.

10. A combustion powered fastener driving tool having a self-contained internal combustion power source and constructed and arranged for creating a combustion for driving a driver blade to impact a fastener and drive it into a work piece, comprising:

a housing having a main chamber enclosing the power source;

a combustion chamber being defined within said main chamber;

a cylinder within said main chamber, and a piston, said cylinder enclosing said piston to drive the driver blade toward the fastener as the piston is driven toward a second end of said cylinder, and said piston configured for reciprocal movement within said cylinder between a start position located at a first end of said cylinder and a driving position located at said second end of said cylinder;

a trigger switch assembly disposed in said housing and connected to said power source for initiating combustion in said combustion chamber, said trigger switch assembly including a trigger operating between an ON position and an OFF position;

a valve assembly for releasably sealing said combustion chamber from atmosphere;

a lockout mechanism connected to said trigger switch assembly and said valve assembly for preventing the opening of said combustion chamber to atmosphere until said trigger is released from said ON position; and delay means connected to said trigger switch assembly for delaying the release of said trigger from said ON position, thereby delaying the opening of said combustion chamber by said valve through said lockout mechanism until said piston returns to said start position after driving the fastener.

11. The tool as defined in claim 10 wherein said delay means is configured to delay the return of said trigger to said OFF position.

12. The tool as defined in claim 10 wherein said trigger switch assembly includes said trigger and a biased return member, and said delay means includes a pneumatic check valve including a cavity with inside walls located in said trigger, and a plunger fixed to said housing and matingly engaged in said cavity, said plunger having a scaling member for wipingly engaging said inside walls so that the engagement of said sealing member with said cavity creates vacuum enhanced friction which counters the action of said biased return member and delays the return of said trigger to said OFF position.

* * * * *